US005918583A

United States Patent [19]

Fukumasu et al.

[11] Patent Number: 5,918,583

[45] Date of Patent: Jul. 6, 1999

[54] AIR-FUEL RATIO CONTROL DEVICE FOR INTERNAL COMBUSTION ENGINE

[75] Inventors: Toshihiro Fukumasu; Yoshiaki Atsumi; Takayuki Otsuka; Hiroshi Kanai, all of Susono, Japan

[73] Assignee: Toyota Jidosha Kabushiki Kaisha, Aichi, Japan

[21] Appl. No.: 08/851,293

[22] Filed: May 5, 1997

[30] Foreign Application Priority Data

May 10, 1996 [JP] Japan ..... 8-116745

[51] Int. Cl.[6] ..... F02D 41/00

[52] U.S. Cl. ..... 123/680

[58] Field of Search ..... 123/680, 681, 123/672, 687, 679, 434, 673, 682

[56] References Cited

U.S. PATENT DOCUMENTS 5,253,630 10/1993 Akazaki et al. ..... 123/682
5,575,266 11/1996 Iida ..... 123/680
5,606,959 3/1997 Maki et al. ..... 123/673
5,611,319 3/1997 Machida ..... 123/680

FOREIGN PATENT DOCUMENTS 62-135626 6/1987 Japan .

*Primary Examiner*—Raymond A. Nelli
*Attorney, Agent, or Firm*—Kenyon & Kenyon

[57] ABSTRACT

An air-fuel ratio control device for an internal combustion engine of a vehicle is disclosed. The device controls the air-fuel ratio with a target value which is larger than the stoichiometric air-fuel ratio, as a control center, in an idle condition. The target value is changed to become small when an amount of intake air in an idle condition is larger than a predetermined value.

13 Claims, 12 Drawing Sheets

AIR-FUEL RATIO CONTROL DEVICE FOR INTERNAL COMBUSTION ENGINE

BACKGROUND OF THE INVENTION

1. Field of the Invention

The present invention relates to an air-fuel ratio control device for an internal combustion engine.

2. Description of the Related Art

An exhaust system of an internal combustion engine is usually provided with a three-way catalytic converter which oxidizes CO and HC, and deoxidizes $NO_x$ so that these three harmful materials in the exhaust gas are converted into harmless materials such as CO2, $H_2O$, and $N_2$. The purifying ability of the three-way catalyst depends on an air-fuel ratio of the mixture in an engine cylinder, and it is known that when the air-fuel ratio is stoichiometric, the three-way catalyst can purify all of these three harmful materials at the same time. To counter a variation of the air-fuel ratio, the three-way catalyst usually has an $O_2$ storage ability such that it absorbs and the stores excess oxygen existing in the exhaust gas when the mixture is on the lean side, and it releases oxygen when the mixture is on the rich side.

By the way, when a temperature of the three-way catalytic converter is very high and the exhaust gas is on rich side, $H_2S$ gas is generated in the three-way catalytic converter. $H_2S$ gas has bad smell. When the vehicle running, the gas is emitted in the atmosphere and thus no problem occurs. However, when the vehicle is stopped, the gas flows into the interior of the vehicle so that the driver has an unpleasant sensation. To prevent this problem, Japanese Unexamined Patent Publication No. 62-135626 discloses an air-fuel ratio control device which controls the air-fuel ratio according to a lean target when the vehicle is stopped, i.e., in an idle engine condition.

Once an air conditioner or the like is used in an idle engine condition, the amount of intake air is increased to increase an engine output in accordance with the increment in the accessory load. If, at this time, the above-mentioned air-fuel ratio control device controls the air-fuel ratio according to the lean target, an amount of extra $O_2$ becomes very large in the three-way catalytic converter, and thus a large amount of $O_2$ close to the limit of $O_2$ storage ability is stored therein. Immediately after the vehicle starts again, the air-fuel ratio is controlled to the stoichiometric target to realize a good engine operating condition, i.e., the air-fuel ratio varies with the stoichiometric air-fuel ratio as a control center. Therefore, when the mixture becomes lean, the three-way catalytic converter cannot absorb the extra $O_2$ so that it cannot deoxidize $NO_x$ sufficiently and thus the amount of $NO_x$ emitted in the atmosphere is increased.

SUMMARY OF THE INVENTION

Therefore, an object of the present invention is to provide an air-fuel ratio control device, which can prevent a bad smell in an idle engine condition and also prevent an increment in the amount of $NO_x$ emitted to the atmosphere immediately after the vehicle has started.

According to the present invention, there is provided a first air-fuel ratio control device for an internal combustion engine of a vehicle comprising: air-fuel ratio control means for controlling the air-fuel ratio with a target value which is larger than the stoichiometric air-fuel ratio, as a control center, in an idle condition; determination means for determining that an amount of intake air in an idle condition is larger than a predetermined value; and changing means for changing the target value to become small when the determination means determines that the amount of intake air is larger than the predetermined value.

According to the present invention, there is provided a second air-fuel ratio control device for an internal combustion engine of a vehicle comprising: air-fuel ratio control means for controlling the air-fuel ratio with a target value which is larger than the stoichiometric air-fuel ratio, as a control center, in an idle condition; grasping means for grasping an integrated amount of intake air during an idle condition; and changing means for changing the target value such that the larger the integrated amount of intake air is, the smaller the target value becomes.

According to the present invention, there is provided a third air-fuel ratio control device for an internal combustion engine of a vehicle comprising: first air-fuel ratio control means for controlling the air-fuel ratio with a first target value which is larger than the stoichiometric air-fuel ratio, as a control center, in an idle condition; determination means for determining that an amount of intake air in an idle condition is larger than a predetermined value; and second air-fuel ratio control means for controlling the air-fuel ratio with a second target value which is smaller than the stoichiometric air-fuel ratio, as a control center, for a period immediately after said vehicle has started, when the determination means determines that the amount of intake air is larger than the predetermined value.

According to the present invention, there is provided a fourth air-fuel ratio control device for an internal combustion engine of a vehicle comprising: air-fuel ratio control means for controlling the air-fuel ratio with a first target value which is larger than the stoichiometric air-fuel ratio, as a control center, in an idle condition; grasping means for grasping an integrated amount of intake air during an idle condition; second air-fuel ratio control means for controlling the air-fuel ratio with a second target value which is smaller than the stoichiometric air-fuel ratio, as a control center, for a period immediately after said vehicle has started; and changing means for changing the second target value such that the larger the integrated amount of intake air is, the smaller the second target value becomes.

According to the present invention, there is provided a fifth air-fuel ratio control device for an internal combustion engine of a vehicle comprising: air-fuel ratio control means for controlling the air-fuel ratio with a first target value which is larger than the stoichiometric air-fuel ratio, as a control center, in an idle condition; grasping means for grasping an integrated amount of intake air during an idle condition; second air-fuel ratio control means for controlling the air-fuel ratio with a second target value which is smaller than the stoichiometric air-fuel ratio, as a control center, for a period immediately after said vehicle has started; and changing means for changing the period such that the larger the integrated amount of intake air is, the longer the period becomes.

The present invention will be more fully understood from the description of preferred embodiments of the invention set forth below, together with the accompanying drawings.

DESCRIPTION OF THE PREFERRED EMBODIMENTS

Figure 1:
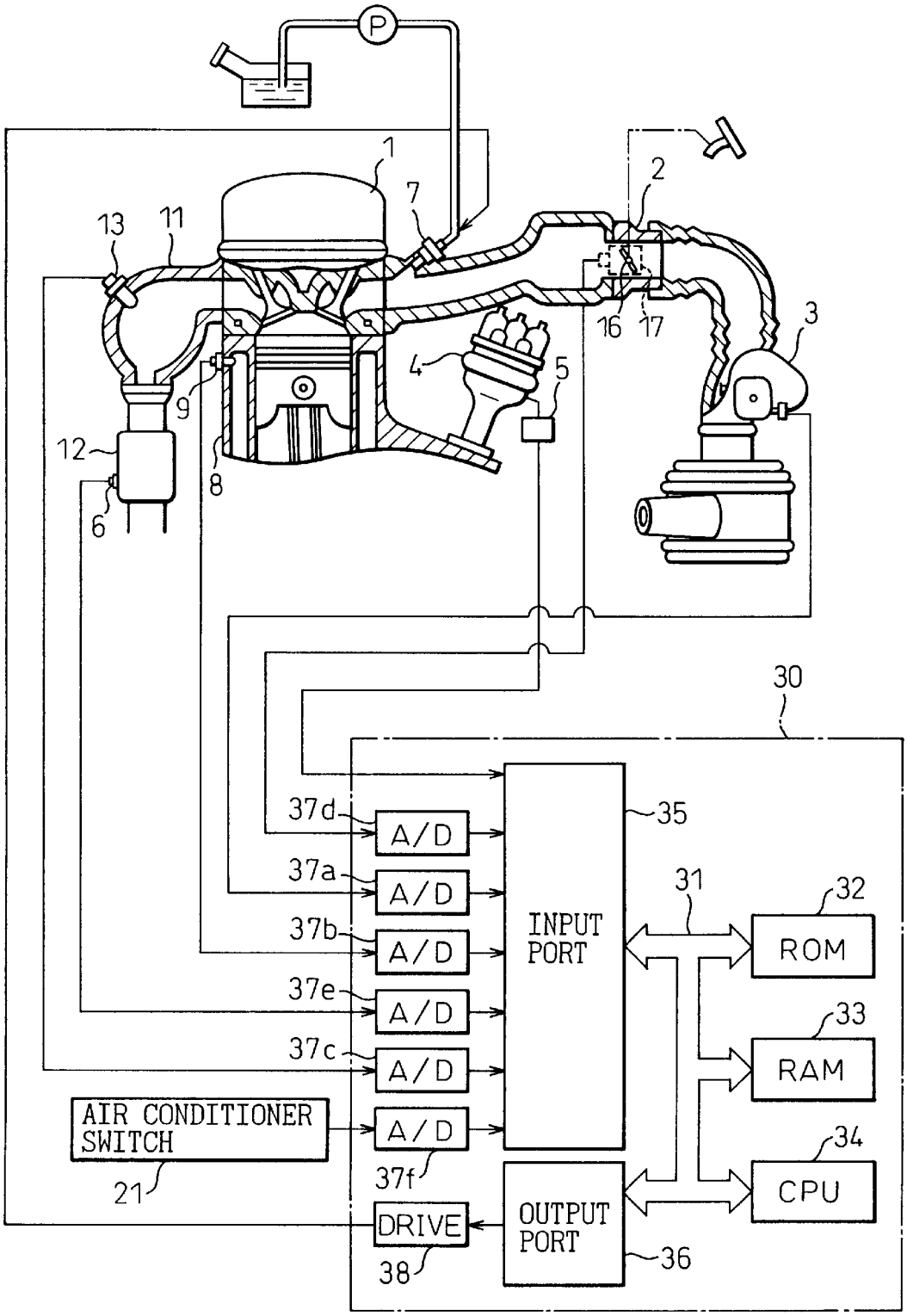
FIG. 1 is a sectional view of an internal combustion engine with an air-fuel ratio control device according to the present invention.

FIG. 1 is a sectional view of an internal combustion engine with an air-fuel ratio control device according to the present invention. Referring to FIG. 1, reference numeral 1 designates an internal combustion engine, 2 an intake passage, 11 an exhaust passage. A fuel injector 7 is arranged downstream of the surge tank in the intake passage 2 every engine cylinders. A throttle valve 16 is arranged upstream of the surge tank in the intake passage 2. A three-way catalytic converter 12 is arranged in the exhaust passage 11.

Reference numeral 30 designates an electronic control unit (ECU) for controlling an amount of fuel injected by the fuel injector 7, i.e., an air-fuel ratio in mixture. The ECU 30 is constructed as a digital computer and includes a ROM (read only memory) 32, a RAM (random access memory) 33, a CPU (microprocessor, etc.) 34, an input port 35, and an output port 36, which are interconnected by a bidirectional bus 31. An air-flow meter 3, which is arranged upstream of the throttle valve 16 in the intake passage 2 and detects an amount of intake air, is connected to the input port 35 via an AD converter 37*a*. A cooling water temperature sensor 9, which is arranged on the cylinder block 8 and detects the temperature of the engine cooling water, is connected to the input port 35 via an AD converter 37*b*. An engine speed sensor 5, which is arranged on the distributor 4 and detects the engine speed, is connected to the input port 35. An $O_2$ sensor 13, which is arranged upstream of the three-way catalytic converter 12 in the exhaust passage 11, is connected to the input port 35 via an AD converters 37*c*. A throttle valve sensor 17, which detects the opening degree of the throttle valve 16, is connected to the input port 35 via an AD converter 37*d*. A temperature sensor 6, which detects the temperature of the three-way catalytic converter 12, is connected to the input port 35 via an AD converter 37*e*. An air conditioner switch 21, which detects an actuation of the air conditioner, is connected to the input port 35 via an AD converter 37*f*. The output port 36 is connected to each fuel injector 7 via a drive circuit 38. The $O_2$ sensor 13 produces, for example, [1V] when the air-fuel ratio in the exhaust gas is on the rich side, [0V] when the air-fuel ratio is on lean side, and an output voltage which varies rapidly between [0V] and [1V] when the air-fuel ratio is nearly stoichiometric.

Figure 2:
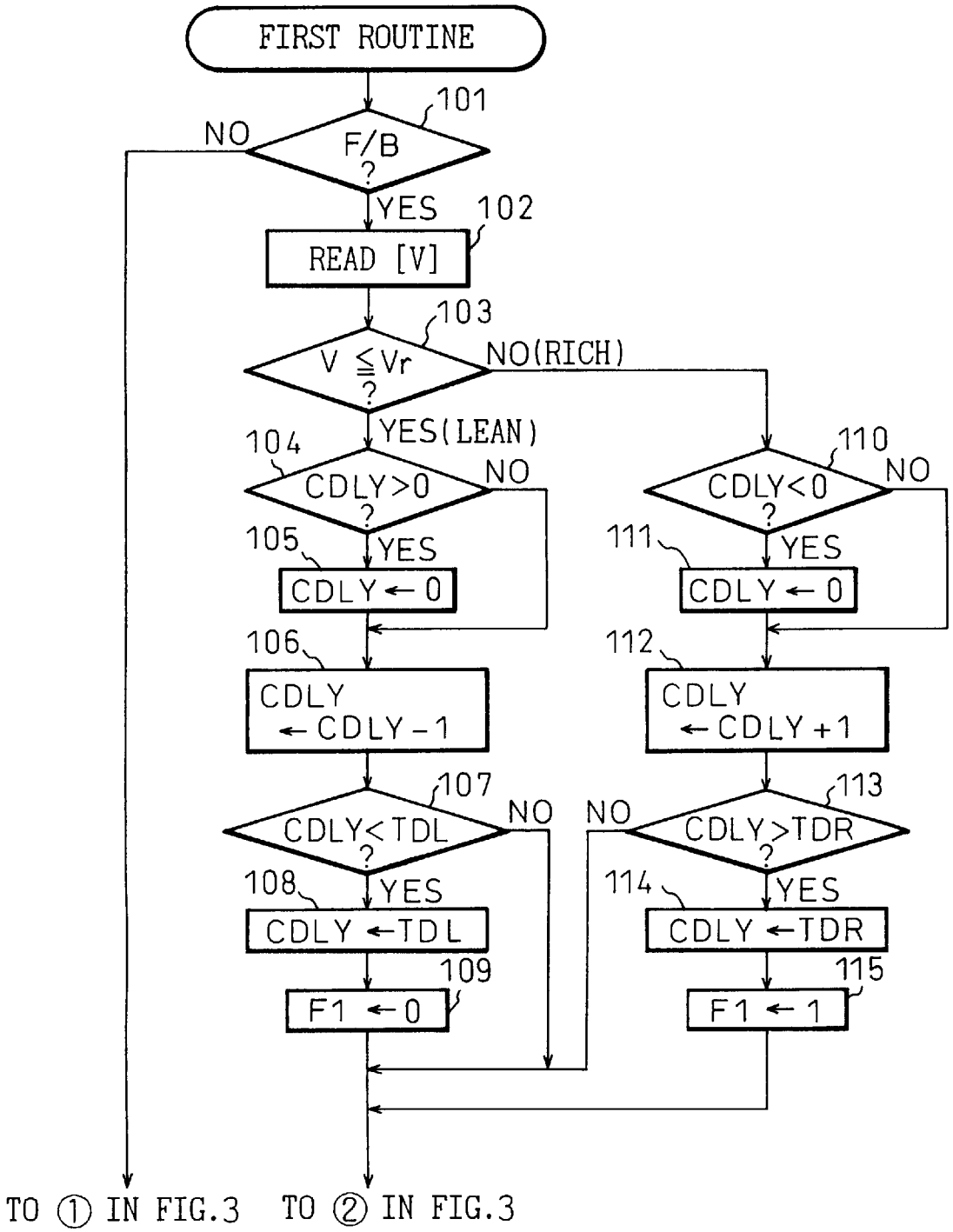
FIG. 2 is a part of a first routine for determining a correction coefficient for correcting the basic amount of fuel.
Figure 3:
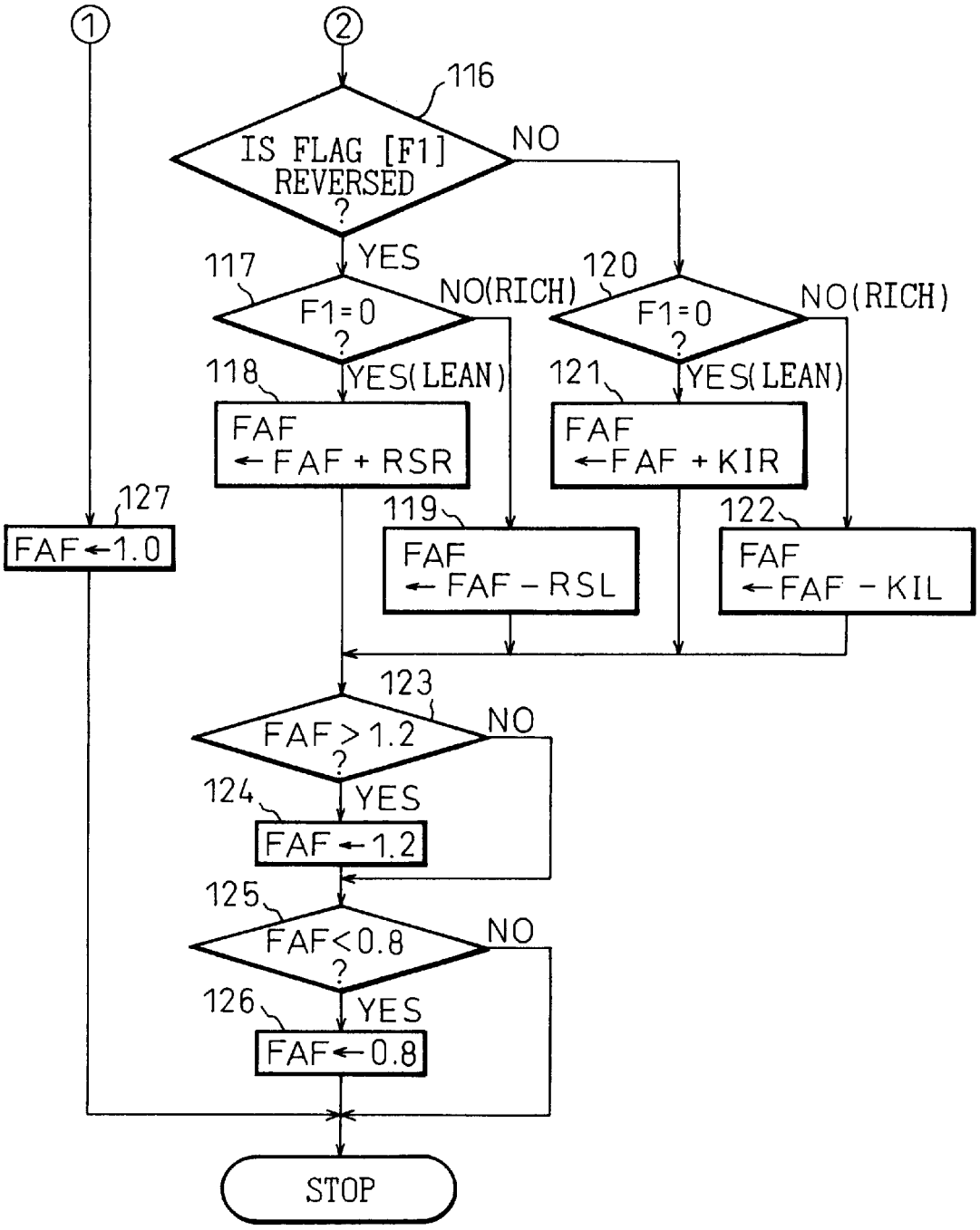
FIG. 3 is the remainder of the first routine.

The ECU 30 controls the amount of fuel injected by the fuel injector 7 by a feed-back air-fuel ratio control, as follows. First, a basic amount of fuel is decided to realize the stoichiometric air-fuel ratio in accordance with a current engine operating condition on the basis of a current amount of intake air detected by the air-flow meter 3 and a current engine speed detected by the engine speed sensor 5. Next, an actual injected amount of fuel is calculated such that the basic amount of fuel is multiplied by a correction coefficient [FAF] decided by a first routine shown FIGS. 2 and 3 on the basis of a current output of the $O_2$ sensor 13.

The first routine is explained as follows. The routine is repeated at every predetermined period. First, at step 101, it is determined if carrying out the above-mentioned feed-back air-fuel ratio control is permitted. When the result is negative, i.e., when the engine is starting, when the fuel increment immediately after the engine has started, when the fuel increment for the engine warming-up, when the fuel is cut, or the like, the routine goes to step 127 and the correction coefficient [FAF] is made [1.0]. Thereafter, the routine is stopped. On the other hand, when the result at step 101 is positive, the routine goes to step 102 and an output voltage [V] of the $O_2$ sensor 13 is read. Next, the routine goes to step 103 and it is determined if the voltage [V] is equal to or lower than a comparison voltage [Vr] (for example, 0.45V) corresponding to the stoichiometric air-fuel ratio, i.e., it is determined if the air-fuel ratio in the exhaust gas is lean.

When the air-fuel ratio is lean (V<=Vr), the routine goes to step 104 and it is determined if a delay count value [CDLY] is larger than [0]. Only when the result is positive, the routine goes to step 105 and the delay count value [CDLY] is made [0]. Next, the routine goes to step 106 and the delay count value [CDLY] is decreased by [1]. At steps 107 and 108, the delay count value [CDLY] is limited to a minimum value [TDL], and only when the delay count value [CDLY] reaches the minimum value [TDL], an air-fuel ratio flag [F1] is made [0] (lean). Here, the minimum value [TDL] corresponds to lean delay time to hold the determination which the air-fuel ratio is still rich although the output of the $O_2$ sensor 13 varies from the rich side to the lean side, and is defined by a negative value.

On the other hand, when the air-fuel ratio is rich (V>Vr), the routine goes to step 110 and it is determined if the delay count value [CDLY] is smaller than [0]. Only when the result is positive, the routine goes to step 111 and the delay count value [CDLY] is made [0]. Next, the routine goes to step 112 and the delay count value [CDLY] is increased by [1]. At steps 113 and 114, the delay count value [CDLY] is limited to a maximum value [TDR], and only when the delay count value [CDLY] reaches the maximum value [TDR], the air-fuel ratio flag [F1] is made [1] (rich). Here, the maximum value [TDR] corresponds to rich delay time to hold the determination which the air-fuel ratio is still lean although the output of the $O_2$ sensor 13 varies from the lean side to the rich side, and is defined by a positive value.

Next, at step 116, it is determined if the air-fuel ratio flag [F1] is reversed, i.e., if the air-fuel ratio is reversed after the above-mentioned delay process. When the air-fuel ratio is reversed, the routine goes to step 117 and it is determined if the air-fuel ratio flag [F1] is [0], i.e., if the air-fuel ratio varies from rich to lean. When the result is positive, the routine goes to step 118 and the correction coefficient [FAF] is increased steeply by a rich skip amount [RSR]. When the result is negative, the routine goes to step 119 and the correction coefficient [FAF] is decreased steeply by a lean skip amount [RSL].

On the other hand, when the result at step 116 is negative, i.e., when the air-fuel ratio flag [F1] is not reversed, the routine goes to step 120 and it is determined if the air-fuel ratio flag [F1] is [0], i.e., if the air-fuel ratio is held lean. When the result is positive, the routine goes to step 121 and the correction coefficient [FAF] is increased gradually by a rich integration amount [KIR]. When the result is negative, the routine goes to step 122 and the correction coefficient [FAF] is decreased gradually by a lean integration amount [KIL]. Here, the integration amounts [KIR, KIL] are set very much smaller than the skip amounts [RSR, RSL].

The correction coefficient [FAF] calculated at step 118, 119, 121, or 122 is limited to a maximum value (for example 1.2) at steps 123 and 124, and is limited to a minimum value (for example 0.8) at steps 125 and 126. Therefore, it is prevented that the correction coefficient [FAF] becomes very large or very small so as to cause the over-rich or over lean air-fuel ratio by any reason.

Figure 4A:
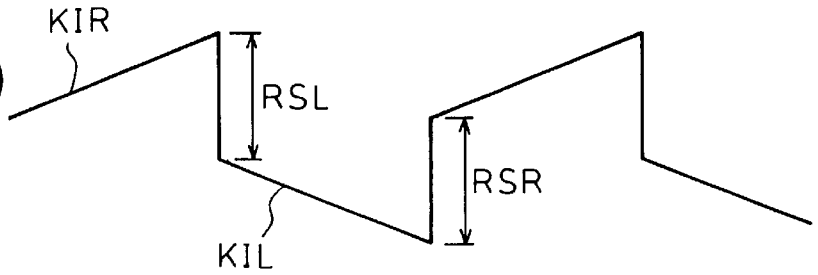
FIG. 4(A) is a first graph showing variations of the correction coefficient.
Figure 5:
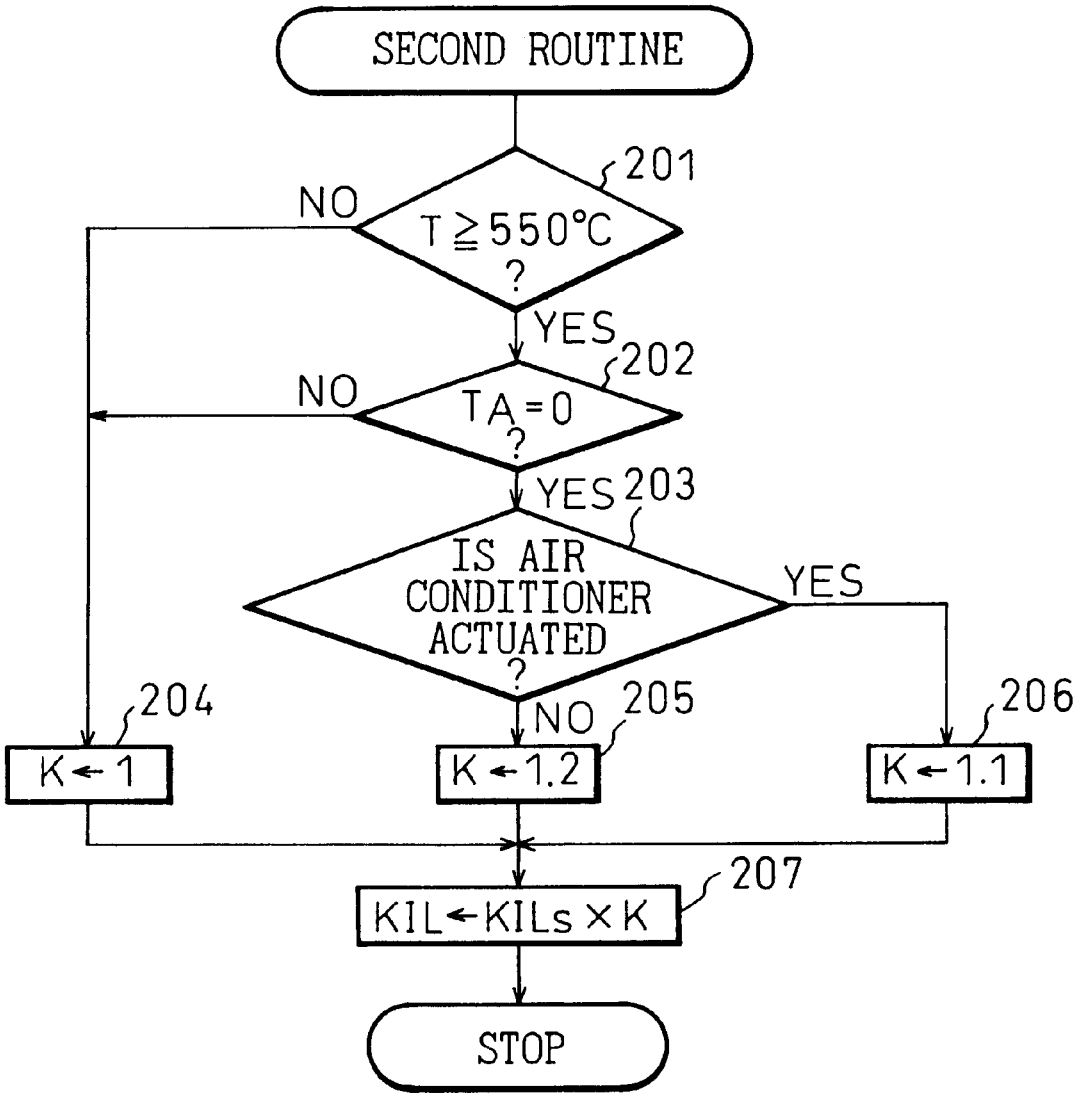
FIG. 5 is a second routine for countering a bad smell.

Usually, the rich skip amount [RSR] is equal to the lean skip amount [RSL] and the rich integration amount [KIR] is equal to the lean integration amount [KIL]. Accordingly, the correction coefficient [FAF] varies as shown FIG. 4(A) by this feed-back air-fuel ratio control and thus, the air-fuel ratio is controlled with the stoichiometric air-fuel ratio as a control center. In case that the temperature of the three-way catalytic converter 12 is very high when the vehicle is stopped, once the air-fuel ratio becomes rich over the stoichiometric air-fuel ratio, $H_2S$ gas, which has bad smell, is generated in the three-way catalytic converter 12 and flows into the interior of the vehicle. This must be prevented. FIG. 5 is a second routine for the countering the bad smell. This is explained as follows.

The second routine is repeated at every predetermined period which is longer than the predetermined period of the first routine. First, at step 201, it is determined if the temperature [T] of the three-way catalytic converter 12 detected by the temperature sensor 6 is equal to or larger than a given high temperature (for example 550 degrees C.). When the result is positive, the routine goes to step 202 and it is determined if the opening degree of the throttle valve [TA] detected by the throttle valve sensor 17 is [0] (fully closed), i.e., if the current engine operating condition is an idle condition. If the result is positive, the air-fuel ratio must become lean to prevent $H_2S$ generation.

For this purpose, according to the second routine, at step 203, it is determined if the air conditioner is actuated on the basis of the output of the air conditioner switch 21. When the result is negative, the routine goes to step 205 and a coefficient [K] is made, for example, [1.2]. Next, at step 207, the lean integration amount [KIL] is calculated to multiply an initial amount [KILs] by the coefficient [K]. Here, the initial amount [KILs] is equally set the rich integration amount [KIR]. Thus, the lean integration amount [KIL] calculated at the second routine is used in the first routine.

On the other hand, when the result at step 203 is positive, i.e., when the air conditioner is actuated, the routine goes to step 206 and the coefficient [K] is made, for example, [1.1]. Next, at step 207, the lean integration amount [KIL] is calculated and is used in the first routine.

On the other hand, in the case that the result at step 201 is negative, even if the air-fuel ratio becomes rich over the stoichiometric air-fuel ratio, $H_2S$ gas is hardly generated so that at step 204, the coefficient [K] is made [1]. Next, at step 207, the lean integration amount [KIL] is calculated. However, it is equal to the rich integration amount [KIR] so that countering the bad smell is not carried out and thus the air-fuel ratio is controlled with the stoichiometric air-fuel ratio, as a control center. In the case that the result at step 202 is negative, even if $H_2S$ gas is generated, $H_2S$ gas flows hardly into the interior of the vehicle since the vehicle is running so that countering the bad smell is not carried out.

Figure 4B:
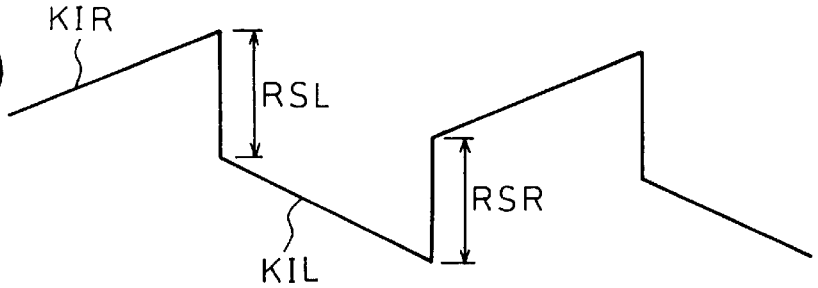
FIG. 4(B) is a second graph showing variations of the correction coefficient.

Thus, when the temperature of the three-way catalytic converter 12 is very high in the idle condition, the lean integration amount [KIL] is increased so that the correction coefficient [FAF] varies as shown in FIG. 4(B). At this time, if the air conditioner is not actuated, the lean integration amount [KIL] is increased with a large increment amount due to the coefficient [K] (=1.2) so that the air-fuel ratio is controlled with a lean target which is a relatively large value, as a control center, and can be surely maintained lean. Thus, $H_2S$ generation can be surely prevented.

On the other hand, if the air conditioner is actuated, an amount of intake air is increased in accordance with the increment of the accessory load. In this case, if the lean integration amount [KIL] is increased with the large increment as mentioned above, an amount of extra $O_2$ in the exhaust gas becomes very large and thus a large amount of $O_2$ close to the limit of $O_2$ storage ability is stored in the three-way catalytic converter 12 before the vehicle starts. Immediately after the vehicle has started again, the coefficient [K] is made [1] and the air-fuel ratio is controlled to vary with the stoichiometric air-fuel ratio as a control center. Therefore, when the air-fuel ratio becomes lean, the three-way catalytic converter 12 cannot absorb the extra $O_2$ so that it cannot deoxidize $NO_x$ sufficiently and thus an amount of $NO_x$ emitted in the atmosphere is increased.

However, according to the second routine, when the air conditioner is actuated in the idle condition, the coefficient [K] is made [1.1] and thus the lean integration amount [KIL] is increased with a small increment amount. Accordingly, the lean target of the air-fuel ratio is made small. However, the lean target does not become smaller than the stoichiometric air-fuel ratio. Therefore, the air-fuel ratio generally becomes more lean than the stoichiometric air-fuel ratio and more rich than the air-fuel ratio when the air conditioner is not actuated. Thus, an amount of extra $O_2$ in the exhaust gas can be reduced in an idle condition so that the three-way catalytic converter 12 can purify $NO_x$ sufficiently immediately after the vehicle starts again.

In the second routine, as the accessory to increase the accessory load, i.e., to increase an amount of intake air, the air conditioner is monitored. If necessary, the lean target may be made small in the feed-back air-fuel ratio control on the basis of the actuation of another accessory, for example, a power steering system or an alternator.

Figure 6:
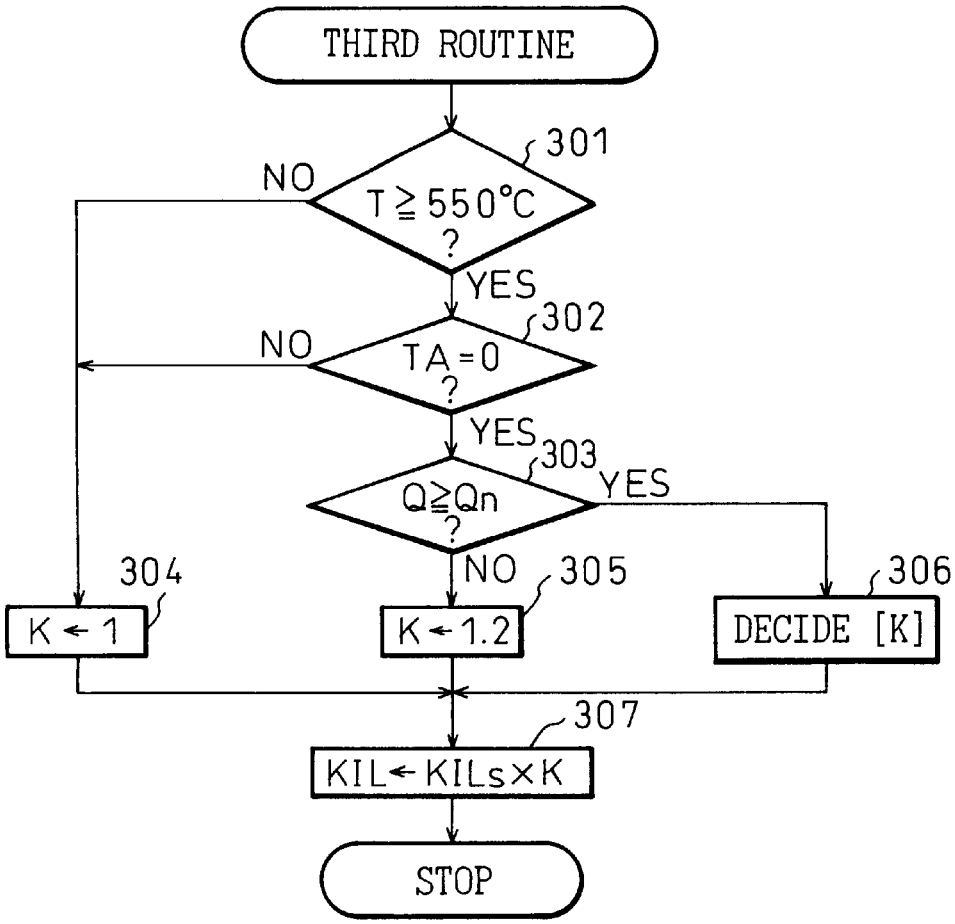
FIG. 6 is a third routine for countering a bad smell.

FIG. 6 shows a third routine for countering the bad smell. The differences between the second and third routines are explained as follows. In the third routine, at step 303, it is determined if a current amount of intake air [Q] detected by the air-flow meter 3 is larger than a normal amount of intake air in an idle condition [Qn], instead of the determination of the actuation of the air conditioner. When the result is negative, the routine goes to step 305 and the coefficient [K] is made [1.2]. Next, at step 307, the lean integration amount [KIL] is calculated on the basis of the coefficient [K].

Therefore, the lean integration amount [KIL] is increased with the large increment and the air-fuel ratio can be surely maintained lean and thus $H_2S$ generation can be surely prevented.

Figure 7:
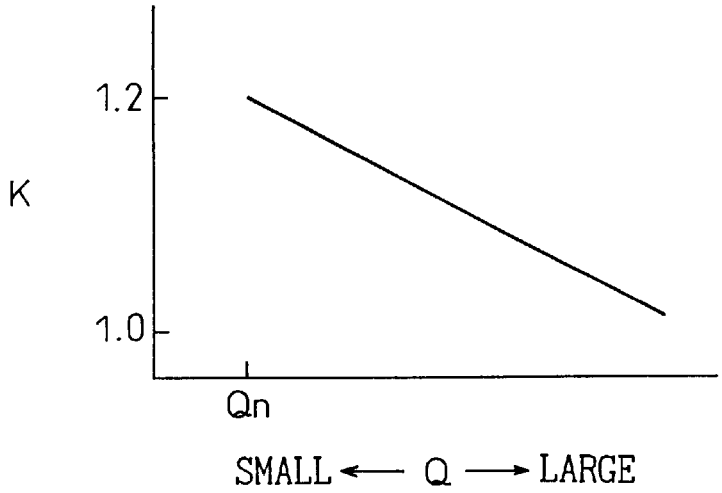
FIG. 7 is a first map for deciding a coefficient used in the third routine.

On the other hand, when the result at step 303 is positive, the routine goes to step 306 and the coefficient [K] is decided from a first map shown in FIG. 7 on the basis of the current amount of intake air [Q]. In the first map, the coefficient [K] varies between [1.2] and [1.0] in accordance with the current amount of intake air [Q], and the larger the current amount of intake air [Q] is, the smaller the coefficient [K] becomes. Next, at step 307, the lean integration amount [KIL] is calculated on the basis of the coefficient [K] decided at step 306.

Therefore, in case that the temperature of the three-way catalytic converter 12 is very high in an idle condition, the larger the amount of intake air [Q] is, the smaller the increment amount of the lean integration amount [KIL] becomes. Accordingly, when the current amount of intake air is equal to or smaller than the normal amount of intake air in an idle condition [Qn], the air-fuel ratio is controlled with the lean target which is a relative large value, as a control center. When the current amount of intake air is larger than the normal amount of intake air in an idle condition [Qn], the lean target of the air-fuel ratio is made small such that the larger the current amount of intake air [Q] is, the smaller the lean target becomes. Therefore, the air-fuel ratio in an idle condition is made as lean as possible such that an amount of extra $O_2$ in the exhaust gas does not increase. Thus, $H_2S$ gas is hardly generated and the three-way catalytic converter 12 can purify $NO_x$ sufficiently immediately after the vehicle has started again.

Figure 8:
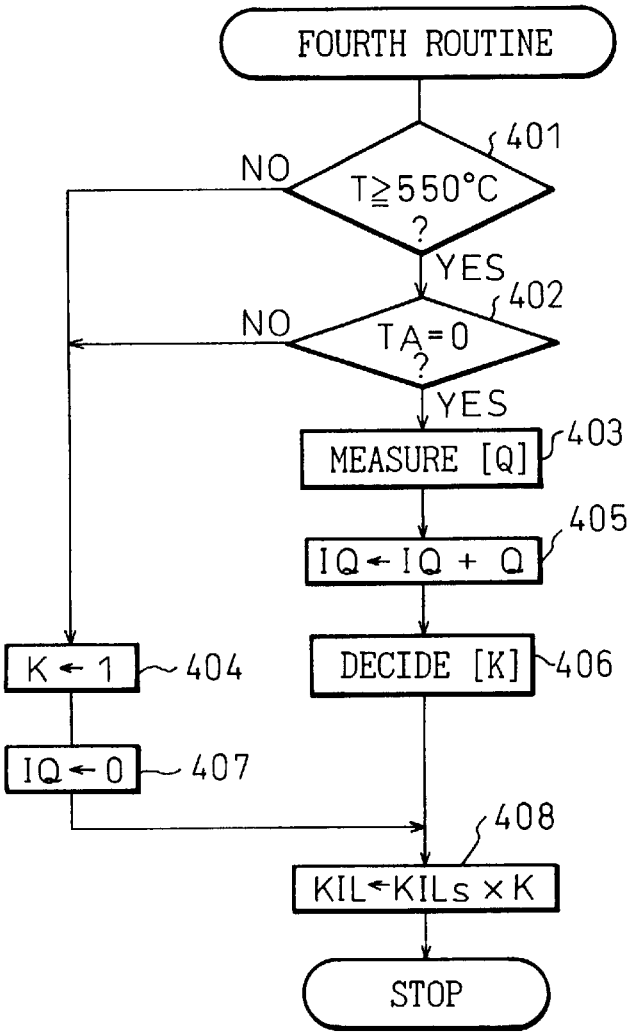
FIG. 8 is a fourth routine for countering a bad smell.
Figure 9:
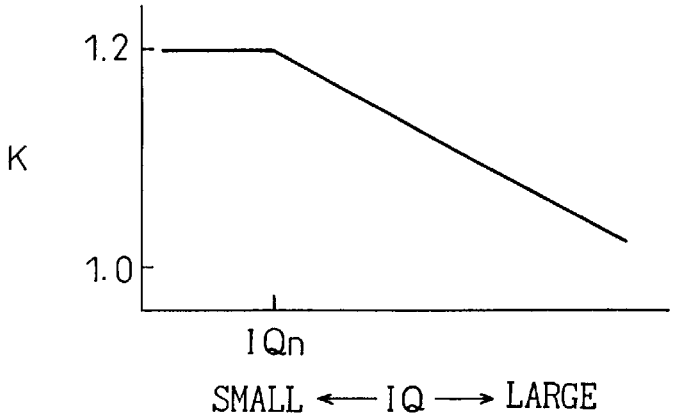
FIG. 9 is a second map for deciding a coefficient used in the fourth routine.

FIG. 8 shows a fourth routine for countering the bad smell. The differences between the second and fourth routines are explained as follows. In the fourth routine, at step 402, it is determined if a current engine operating condition is an idle condition. When the result is positive, the routine goes to step 403 and a current amount of intake air [Q] is detected by the air-flow meter 3. Next, at step 405, an amount of intake air [Q] in the idle condition is integrated and thus an integrated amount of intake air [IQ] while the vehicle is stopped is calculated. Next, at step 406, the coefficient [K] is decided from a second map shown in FIG. 9 on the basis of the integrated amount of intake air [IQ]. In the second map, the coefficient [K] varies between [1.2] and [1.0] in accordance with the integrated amount of intake air [IQ], and the coefficient [K] is [1.2] when the integrated amount of intake air [IQ] is smaller than a predetermined value [IQn], and the larger the integrated amount of intake air [IQ] is, the smaller the coefficient [K] becomes. Next, at step 408, the lean integration amount [KIL] is calculated on the basis of the coefficient [K] decided at step 406. On the other hand, when the result at step 401 or 402 is negative, the routine goes to step 404 and the coefficient [K] is made [1]. Thereafter, at step 407, the integrated amount of intake air [IQ] is reset to [0].

Therefore, in case that the temperature of the three-way catalytic converter 12 is very high in an idle condition, when the integrated amount of intake air [IQ] is larger than the predetermined value [IQn], the larger the integrated amount of intake air [IQ] is, the smaller the increment amount of the lean integration amount [KIL] becomes. Accordingly, when the integrated amount of intake air [IQ] is equal to or smaller than the predetermined value [IQn], the air-fuel ratio is controlled with the lean target which is a relatively large value, as a control center. When the integrated amount of intake air [IQ] is larger than the predetermined value [IQn], the lean target of the air-fuel ratio is made small such that the larger the integrated amount of intake air [IQ] is, the smaller the lean target becomes. Therefore, the air-fuel ratio in an idle condition is made as lean as possible such that an amount of extra $O_2$ in the exhaust gas does not increase. Thus, $H_2S$ gas is hardly generated and the three-way catalytic converter 12 can purify $NO_x$ sufficiently immediately after the vehicle starts.

Moreover, according to the fourth routine, in contrast to the third routine, in the case that a current amount of intake air is large but the vehicle starts quickly, the integrated amount of intake air [IQ] does not become larger than the predetermined value [IQn] and the lean integration amount [KIL] is increased with the large increment by the coefficient [K] (=1.2). Therefore, at this time, the three-way catalytic converter 12 does not still store a large amount of $O_2$, close to the limit of its $O_2$ storage ability, so that the relative large lean target is used and thus the generation of $H_2S$ gas can be surely prevented. On the other hand, in the case that a current amount of intake air is small but the vehicle is stopped for a long time, the integrated amount of intake air [IQ] becomes larger than the predetermined value [IQn] and the lean integration amount [KIL] is increased with the small increment by the coefficient [K] (<1.2). Therefore, at this time, it is prevented that the three-way catalytic converter 12 stores a large amount of $O_2$ close to the limit of $O_2$ its storage ability.

Figure 10:
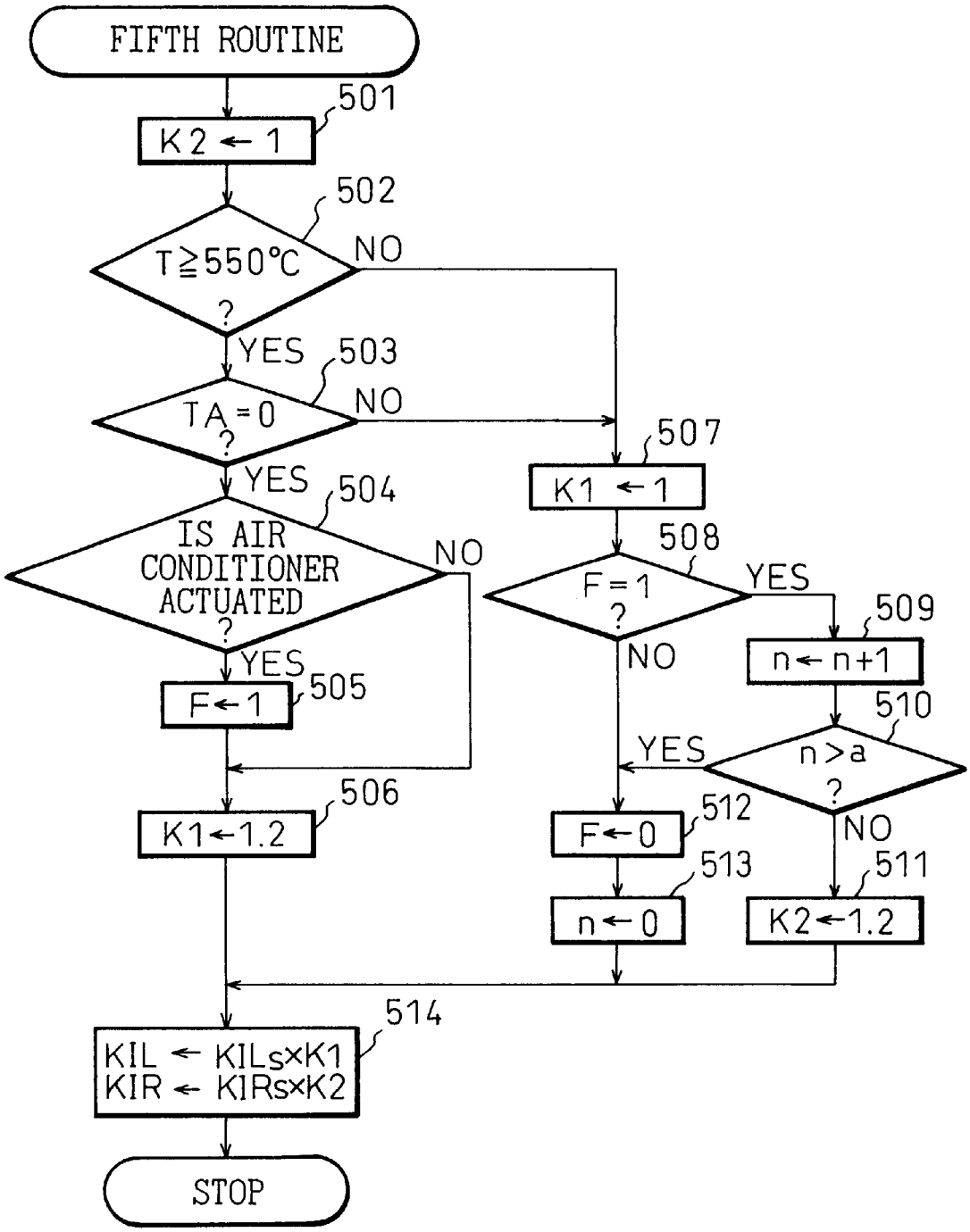
FIG. 10 is a fifth routine for countering a bad smell.

FIG. 10 shows a fifth routine for countering the bad smell. The fifth routine is repeated at every predetermined period which is longer than the predetermined period of the first routine. First, at step 501, a second coefficient [K2] for calculating the rich integration amount [KIR] used in the first routine is made [1]. Next, at step 502, it is determined if the temperature [T] of the three-way catalytic converter 12 detected by the temperature sensor 6 is equal to or larger than a given high temperature (for example 550 degrees C.). When the result is positive, the routine goes to step 503 and it is determined if the opening degree of the throttle valve [TA] detected by the throttle valve sensor 17 is [0] (fully close), i.e., if the current engine operating condition is an idle condition. When the result is positive, the routine goes to step 504 and it is determined if the air conditioner is actuated on the basis of the output of the air conditioner switch 21.

Only when the result is positive, does the routine go to step 505 and a flag [F] which is set to [0] initially is made [1]. Next, at step 506, a first coefficient [K1] for calculating the lean integration amount [KIL] used in the first routine is made [1.2]. Next, at step 514, the lean integration amount [KIL] is calculated to multiply a lean initial amount [KILs] by the coefficient [K1], and the rich integration amount [KIR] is calculated to multiply a rich initial amount [KIRs] by the coefficient [K2]. Thus, the lean integration amount [KIL] and rich integration amount [KIR] are used in the first routine. Here, the lean initial amount [KILs] is equal to the rich initial amount [KIRs].

Here, the first coefficient [K1] is [1.2] and the second coefficient [K2] is [1]. Accordingly, only the lean integration amount [KIL] is increased with the large increment so that the correction coefficient [FAF] varies as shown in FIG. 4(B). Thus the air-fuel ratio is controlled with the lean target which is a relatively large value, as a control center. The generation of $H_2S$ gas can be prevented.

On the other hand, when the temperature of the three-way catalytic converter 12 is not very high or the current engine operating condition is not an idle condition, the routine goes to step 507 and the first coefficient [K1] is made [1]. Next, at step 508, it is determined if the flag [F] is [1]. When the result is negative, i.e., in the case that the air conditioner is actuated when the air-fuel ratio is made lean for countering the bad smell, the routine goes to step 509 and the count value [n] is increased by [1]. Next, at step 510, it is determined if the count value [n] is larger than a set value [a]. Namely, in the case that countering the bad smell is carried out when the vehicle stops, it is determined if a period immediately after the vehicle has started is finished. At first, the result is negative and the routine goes to step 511.

Figure 4C:
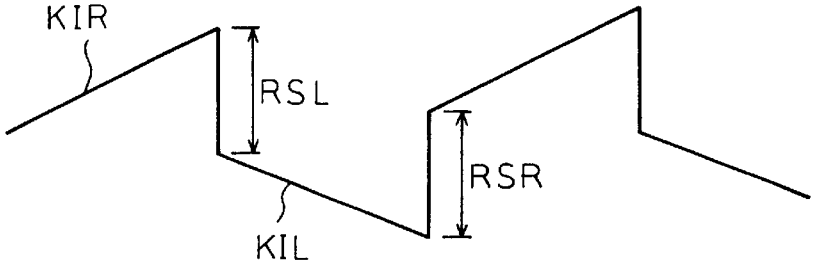
FIG. 4(C) is a third graph showing variations of the correction coefficient.

At step 511, the second coefficient [K2] is made, for example, [1.2]. Accordingly, at step 514, only the rich integration amount [KIR] is increased with a large increment so that the correction coefficient [FAF] varies as shown in FIG. 4(C) and thus the air-fuel ratio is controlled to vary with a rich target as a control center. Therefore, at this time, the three-way catalytic converter 12 stores a large amount of $O_2$ close to the limit of $O_2$ storage ability thereof. However, the air-fuel ratio is made rich so that the stored $O_2$ can be released in the early stage and thus a good purification of $NO_x$ can be realized.

On the other hand, in the case that countering the bad smell is carried out when the vehicle stops, when the period immediately after the vehicle has started is finished, an amount of $O_2$ stored in the three-way catalytic converter 12 becomes optimal due to the above-mentioned $O_2$ release so that a good purification of harmful materials can be supplied using to the $O_2$ storage ability and the air-fuel ratio is not required to be rich. Accordingly, when the result at step 510 is positive, the routine goes to step 512 and the flag [F] is reset to [0]. Next, at step 513, the count value [n] is reset to [0] and the routine goes to step 514. At this time, the first coefficient [K1] is made [1] at step 507 and the second coefficient [K2] is made [1] at step 501 so that the lean and rich integration amounts [KIL], [KIR] are made initial amounts [KILs], [KIRs], respectively. Therefore, the correction coefficient [FAF] varies as shown in FIG. 4(A) and thus the air-fuel ratio is controlled with the stoichiometric target. On the other hand, in case that the air conditioner is not actuated when countering the bad smell is carried out, an amount of $O_2$ stored in the three-way catalytic converter 12 is not very large and the air-fuel ratio is not required to be rich. At this time, the flag [F] is [0] so that the result at step 508 is negative and the routine goes to step 512. Thus, the air-fuel ratio is controlled with the stoichiometric target.

Figure 11:
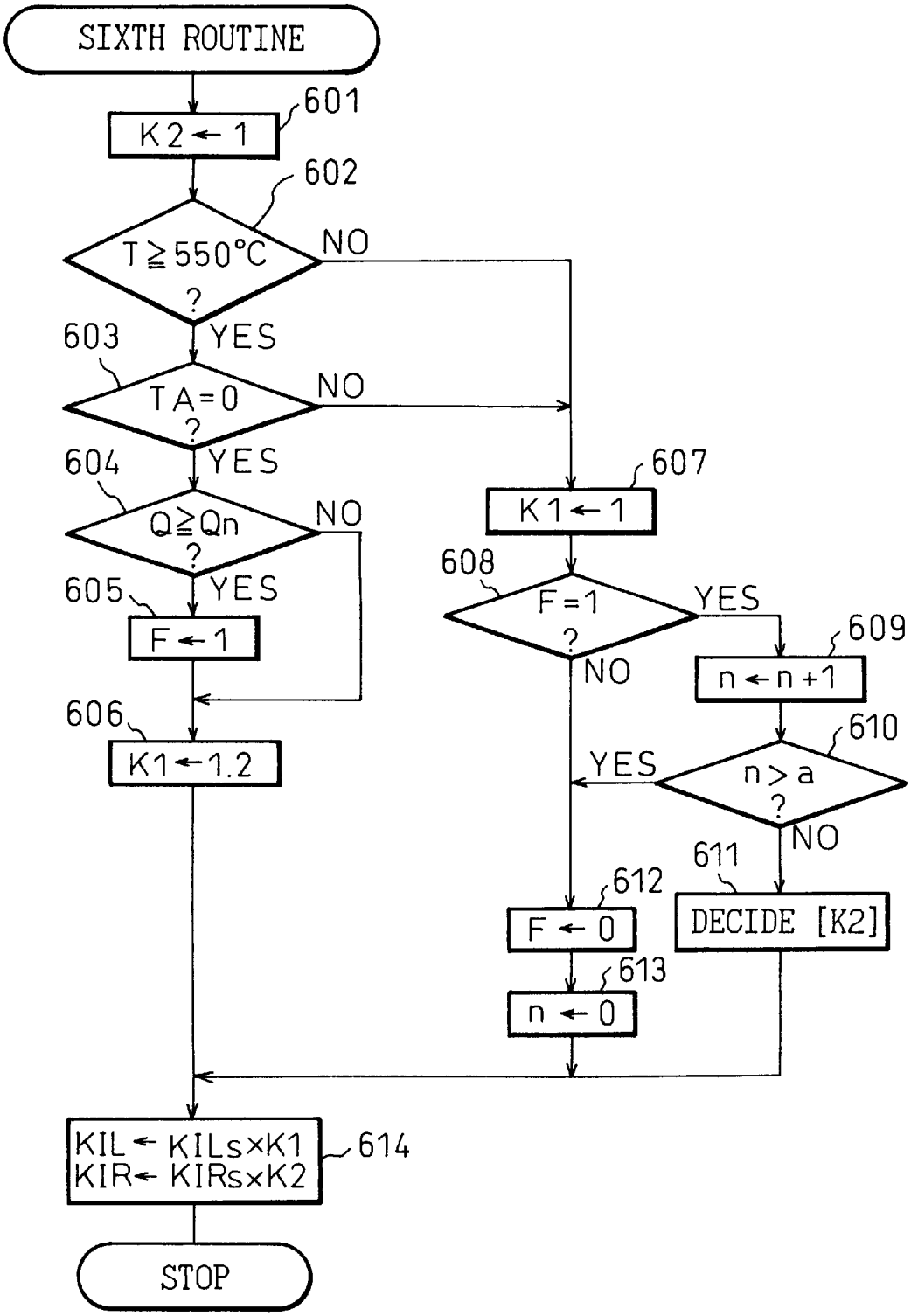
FIG. 11 is a sixth routine for countering a bad smell.
Figure 12:
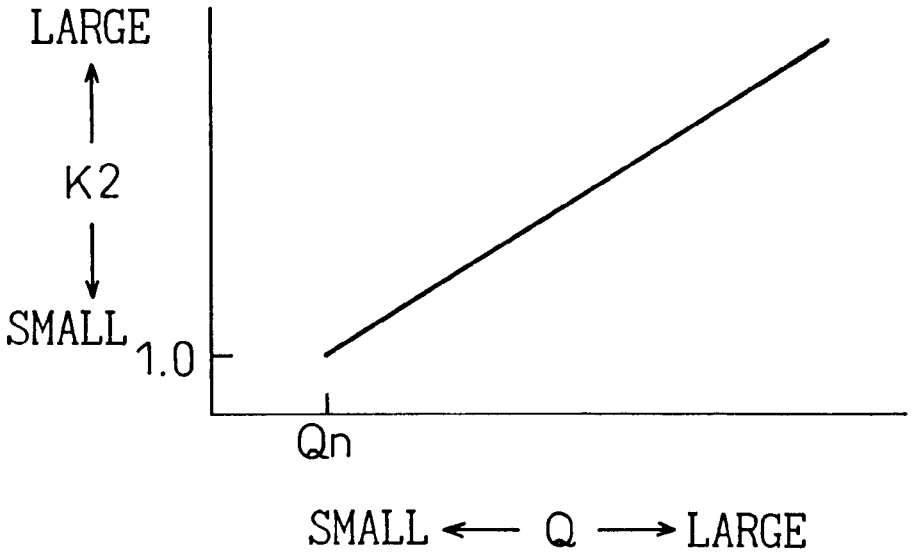
FIG. 12 is a third map for deciding a second coefficient used in the sixth routine.

FIG. 11 shows a sixth routine for countering the bad smell. The differences between the fifth and sixth routines are explained as follows. In the sixth routine, at step 604, it is determined if a current amount of intake air [Q] detected by the air-flow meter 3 is larger than a normal amount of intake air [Qn] in an idle condition, instead of the determination of the actuation of the air conditioner. Only when the result is positive, does the routine go to step 605 and the flag [F] is made [1]. Next, at step 606, the first coefficient [K1] is made [1.2]. In the case that the temperature of the three-way catalytic converter 12 is very high in an idle condition, countering the bad smell is carried out. In the case that an amount of intake air is large when countering the bad smell is carried out, the second coefficient [K2] is decided from a third map shown in FIG. 12 on the basis of the amount of intake air [Q] at step 611, and the second coefficient [K2] is used for the predetermined time. In the third map, the second coefficient [K2] is set [1.0] when the amount of intake air is equal to or smaller than the normal amount of intake air in an idle condition [Qn], and the second coefficient [K2] is set such that the larger the amount of intake air [Q] is, the larger the second coefficient [K2] becomes.

Figure 13:
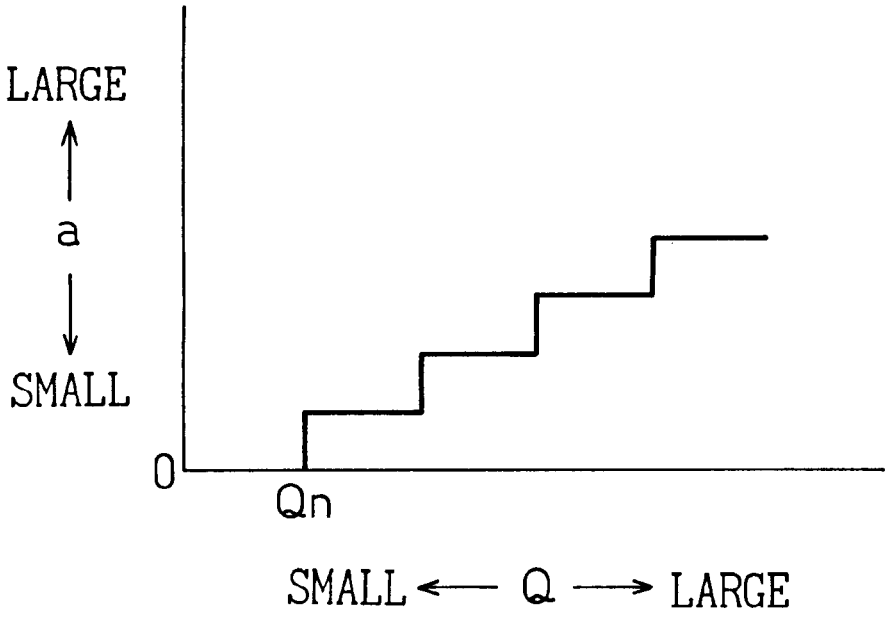
FIG. 13 is a fourth map for changing a set value used in the sixth routine.

Therefore, in the case that an amount of intake air is large when the air-fuel ratio is controlled to the relative large lean target in an idle condition to counter the bad smell, the larger an amount of intake air [Q] is in an idle condition, the larger the increment amount of the rich integration amount [KIR] becomes for the period immediately after the vehicle has started. Thus, the larger an amount of intake air is, the smaller the rich target of the air-fuel ratio becomes. Namely, the larger an amount of $O_2$ stored in the three-way catalytic converter 12 is when the vehicle starts, the more the air-fuel ratio becomes rich. Therefore, the stored $O_2$ can be released in the early stage and thus a good purification of $NO_x$ can be realized. Moreover, according to the sixth routine, when the vehicle starts, the rich target does not become smaller than the three-way catalytic converter 12 requires so that a good engine operating condition can be realized. In the sixth routine, the set value [a] used at step 610 may be decided from a fourth map shown in FIG. 13 on the basis of an amount of intake air [Q] in an idle condition, instead of or in addition to the variation of the second coefficient [K2] in accordance with an amount of intake air [Q] in an idle condition. In the fourth map, the larger an amount of intake air [Q] is in an idle condition, the larger the set value [a] becomes. Therefore, the smaller an amount of intake air [Q] is in an idle condition, the shorter the period immediately after the vehicle has started in which the air-fuel ratio is made rich becomes. Thus, the period does not become longer than the three-way catalytic converter 12 requires.

Figure 14:
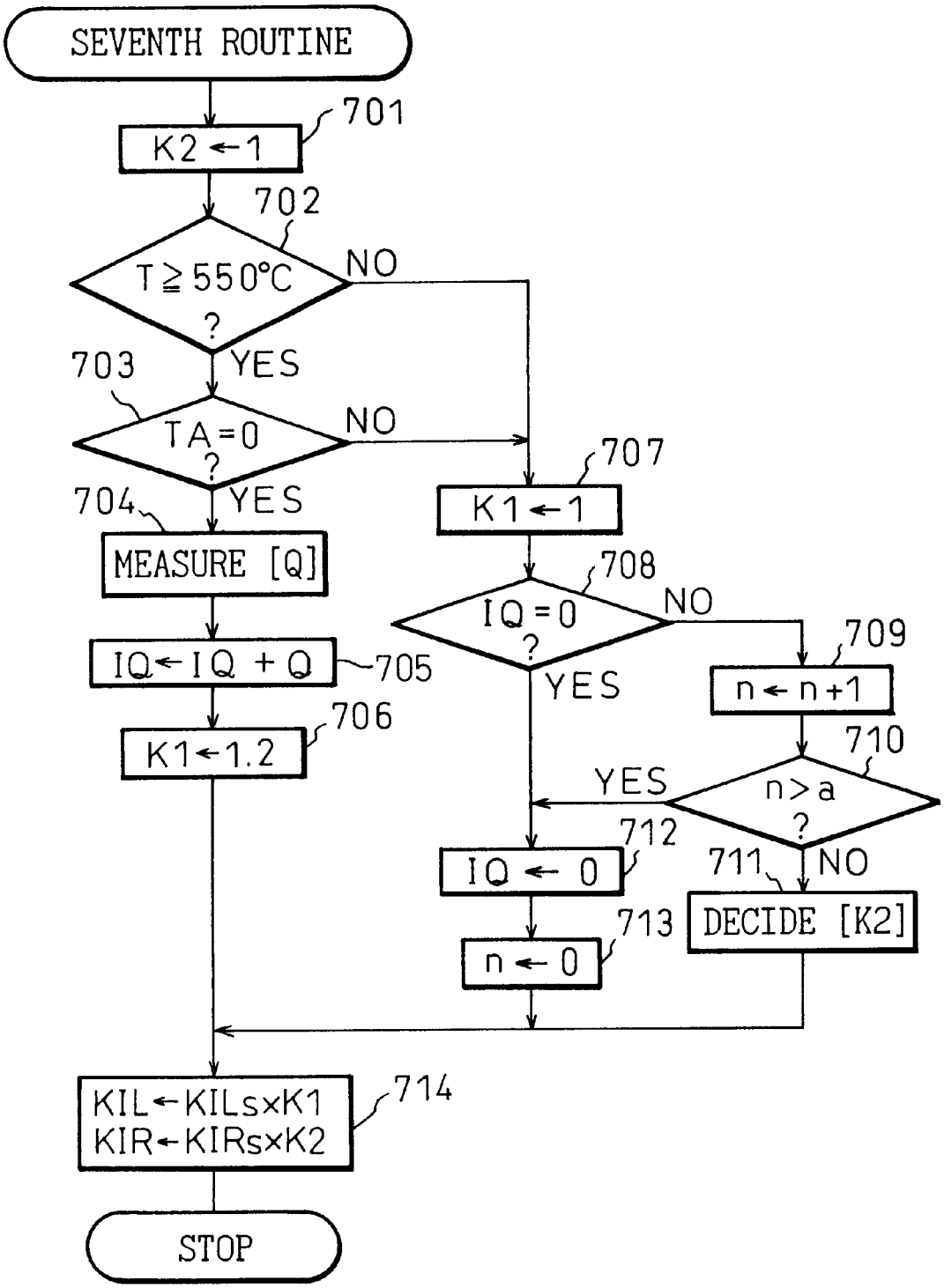
FIG. 14 is a seventh routine for countering a bad smell.

FIG. 14 shows a seventh routine for countering the bad smell. The differences between the fifth and seventh routines are explained as follows. In the seventh routine, at step 703, it is determined if the opening degrees of the throttle valve [TA] is [0]. When the result is positive, the routine goes to step 704 and an amount of intake air [Q] is measured by the air-flow meter 3. Next, at step 705, an integrated amount of intake air [IQ] is calculated and at step 706, the first coefficient [K1] is made, for example, [1.2]. Accordingly, only the lean integration amount [KIL] is increased with the large increment and thus the air-fuel ratio is controlled with the relative large lean target.

Figure 15:
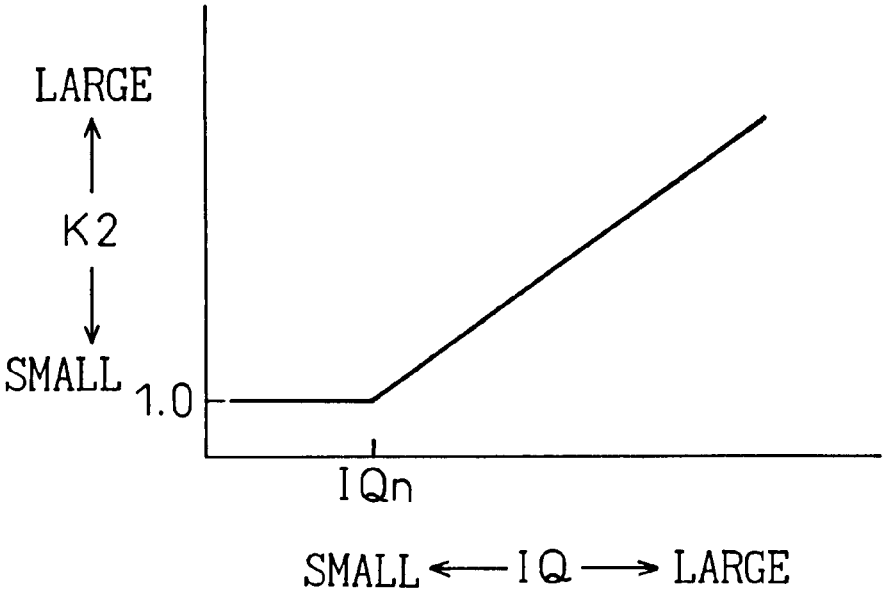
FIG. 15 is a fifth map for deciding a second coefficient used in the seventh routine.

On the other hand, when the vehicle starts after the idle condition, the first coefficient [K1] is made [1] at step 707. At step 708, it is determined if the integrated amount of intake air [IQ] is [0]. At first, the result is negative and the routine goes to step 709. For a period immediately after the vehicle has started, the second coefficient [K2] is decided from a fifth map shown in FIG. 15 on the basis of the integrated amount of intake air [IQ]. In the fifth map, the second coefficient [K2] is [1] when the integrated amount of intake air [IQ] is equal to or smaller than a predetermined value [IQn], and the larger the integrated amount of intake air [IQ] is, the larger the second coefficient [K2] becomes, when the integrated amount of intake air [IQ] is larger than the predetermined value [IQn].

Therefore, for the period after the vehicle has started, the larger the integrated amount of intake air [IQ] is, the larger the rich integration amount [KIR] only becomes. Namely, the larger the integrated amount of intake air is, the smaller the rich target of the air-fuel ratio becomes. Thus, in the case that countering the bad smell is carried out in an idle condition, when the vehicle starts, the larger an amount of $O_2$ stored in the three-way catalytic converter 12 is, the more the air-fuel ratio becomes rich. Therefore, the stored $O_2$ can be released in the early stage and thus a good purification of $NO_x$ can be realized. Moreover, according to the seventh routine, when the vehicle starts, the rich target does not become smaller than the three-way catalytic converter 12 requires so that a good engine operating condition can be realized.

Figure 16:
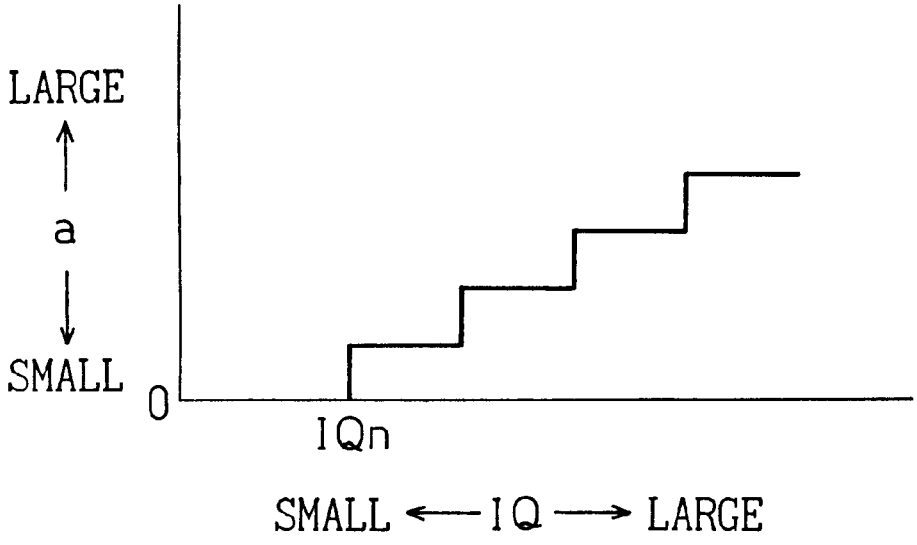
FIG. 16 is a sixth map for changing a set value used in the seventh routine.

In the seventh routine, the set value [a] used at step 710 may be decided from a sixth map shown in FIG. 16 on the basis of the integrated amount of intake air in an idle condition, instead of or in addition to the variation of the second coefficient [K2] in accordance with the integrated amount of intake air [IQ] in an idle condition. Accordingly, the smaller the integrated amount of intake air [IQ] is, the shorter the period immediately after the vehicle has started in which the air-fuel ratio is made rich becomes. Thus, the period in which the air-fuel ratio is made rich does not become longer than the three-way catalytic converter 12 requires.

In the above-mentioned second, third, and fourth routines, the lean integration amount [KIL] is increased so that the air-fuel ratio becomes lean. However, the lean skip amount [RSL], the absolute value of the lean delay time [TDL], or the comparison voltage [Vr] used in the first routine may be increased, instead of the increment of the lean integration amount [KIL].

In the above-mentioned fifth, sixth, and seventh routines, the rich integration amount [KIR] is increased so that the air-fuel ratio becomes rich. However, the rich skip amount [RSR] or the absolute value of the rich delay time [TDR] may be increased, or the comparison voltage [Vr] may be decreased, instead of the increment of the rich integration amount [KIL]. In an internal combustion engine which carries out the fuel injection prior to an intake stroke in addition to the fuel injection during the intake stroke to increase an amount of fuel injected in an acceleration, an amount of fuel injected prior to the intake stroke may be increased so that the air-fuel ratio becomes rich. In an internal combustion engine which the air-fuel ratio is kept at the stoichiometric air-fuel ratio by taking account of an amount of fuel stuck on the wall of intake port by use of a linear output type air-fuel ratio sensor which can detect the air-fuel ratio in the exhaust gas, another correction coefficient which corrects the basic amount of fuel by taking account of an amount of fuel stuck on the wall of the intake port may be increased so that the air-fuel ratio becomes rich.

In the above-mentioned second, third, and fourth routines, the air-fuel ratio is controlled with the lean target to counter the bad smell in an idle condition, and the lean target is made small so as to not become smaller than the stoichiometric air-fuel ratio when the amount of intake air in an idle condition is large. This does not limit to the present invention. The air-fuel ratio may be controlled with a target which is smaller than the stoichiometric air-fuel ratio for a short period, in an idle condition. In this case, if an amount of intake air in an idle condition or an integrated amount of intake air during an idle condition is detected, the short period or the target may be decided on the basis thereof.

At step 306 in the third routine and at step 611 in the sixth routine, the coefficient [K] or the second coefficient [K2] is decided on the amount of intake air [Q] in an idle condition. If the amount of intake air varies in an idle condition, a maximum amount of intake air in the idle condition or an average amount of intake air in the idle condition can be used to decide the coefficients.

In the above-mentioned first, second, third, and fifth maps, each coefficient varies linearly in accordance with the amount of intake air or the integrated amount of intake air. Each coefficient may vary non-linearly in accordance with the amount of intake air or the integrated amount of intake.

The first routine is for an air-fuel ratio control using only an $O_2$ sensor arranged upstream of the three-way catalytic converter. However, the ideas of the present invention are applicable to an routine for an air-fuel ratio control using $O_2$ sensors arranged upstream and downstream of the three-way catalytic converter respectively.

Although the invention has been described with reference to specific embodiments thereof, it should be apparent that numerous modifications can be made thereto by those skilled in the art, without departing from the basic concept and scope of the invention.

I claim:

1. An air-fuel ratio control device for an internal combustion engine of a vehicle comprising:

air-fuel ratio control means for controlling the air-fuel ratio with a target value which is larger than the stoichiometric air-fuel ratio, as a control center, in an idle condition;

determination means for determining that an amount of intake air in an idle condition is larger than a predetermined value; and changing means for changing said target value to become small when said determination means determines that said amount of intake air is larger than said predetermined value.

2. A device according to claim 1, wherein said changing means changes said target so as not to become smaller than the stoichiometric air-fuel ratio.

3. A device according to claim 1, wherein said determination means determines that said amount of intake air is larger than said predetermined value on the basis of the actuation of any accessory of said engine which causes an amount of intake air to increase.

4. A device according to claim 1, wherein said determination means has grasping means for grasping said amount of intake air and said changing means changes said target value such that the larger said amount of intake air is, the smaller said target value becomes.

5. A device according to claim 4, wherein said changing means changes said target so as not to become smaller than the stoichiometric air-fuel ratio.

6. An air-fuel ratio control device for an internal combustion engine of a vehicle comprising:

air-fuel ratio control means for controlling the air-fuel ratio with a target value which is larger than the stoichiometric air-fuel ratio, as a control center, in an idle condition;

grasping means for grasping an integrated amount of intake air during an idle condition; and changing means for changing said target value such that the larger said integrated amount of intake air is, the smaller said target value becomes.

7. A device according to claim 6, wherein said changing means changes said target so as not to become smaller than the stoichiometric air-fuel ratio.

8. An air-fuel ratio control device for an internal combustion engine of a vehicle comprising:

first air-fuel ratio control means for controlling the air-fuel ratio with a first target value which is larger than the stoichiometric air-fuel ratio, as a control center, in an idle condition;

determination means for determining that an amount of intake air in an idle condition is larger than a predetermined value; and second air-fuel ratio control means for controlling the air-fuel ratio with a second target value which is smaller than the stoichiometric air-fuel ratio, as a control center, for a period immediately after said vehicle has started, when said determination means determines that said amount of intake air is larger than said predetermined value.

9. A device according to claim 8, wherein said determination means determines that said amount of intake air is larger than said predetermined value on the basis of the actuation of any accessory of said engine which causes an amount of intake air to increase.

10. A device according to claim 8, wherein said determination means has grasping means for grasping said amount of intake air, and further comprising changing means for changing said second target value such that the larger said amount of intake air is, the smaller said second target value becomes.

11. A device according to claim 8, wherein said determination means has grasping means for grasping said amount of intake air, and further comprising changing means for changing said period such that the larger said amount of intake air is, the longer said period becomes.

12. An air-fuel ratio control device for an internal combustion engine of a vehicle comprising:

air-fuel ratio control means for controlling the air-fuel ratio with a first target value which is larger than the stoichiometric air-fuel ratio, as a control center, in an idle condition;

grasping means for grasping an integrated amount of intake air during an idle condition;

second air-fuel ratio control means for controlling the air-fuel ratio with a second target value which is smaller than the stoichiometric air-fuel ratio, as a control center, for a period immediately after said vehicle has started; and changing means for changing said second target value such that the larger said integrated amount of intake air is, the smaller said second target value becomes.

13. An air-fuel ratio control device for an internal combustion engine of a vehicle comprising:

air-fuel ratio control means for controlling the air-fuel ratio with a first target value which is larger than the stoichiometric air-fuel ratio, as a control center, in an idle condition;

grasping means for grasping an integrated amount of intake air during an idle condition;

second air-fuel ratio control means for controlling the air-fuel ratio with a second target value which is smaller than the stoichiometric air-fuel ratio, as a control center, for a period immediately after said vehicle has started; and changing means for changing said period such that the larger said integrated amount of intake air is, the longer said period becomes.

* * * * *